US005931581A

United States Patent [19]

Garberg et al.

[11] Patent Number: 5,931,581

[45] Date of Patent: Aug. 3, 1999

[54] SELF-SEALABLE PACKAGING FOR ENCLOSING ARTICLES

[75] Inventors: Dennis D. Garberg; Thomas J. Butler, both of Overland Park, Kans.; Charles Coleman, Ridge, N.Y.; Lester Land, Parker, Kans.; Danny Hendricks, Independence, Mo.; Tim Ryan, Willard, Mo.; Carl Medlin, Kansas City, Mo.

[73] Assignee: Dennis Garberg & Associates, Inc., Overland Park, Kans.

[21] Appl. No.: 08/856,625

[22] Filed: May 19, 1997

[51] Int. Cl.[6] ..... B65D 33/14; B65D 33/20

[52] U.S. Cl. ..... 383/9; 383/62; 383/84

[58] Field of Search ..... 383/9, 5, 37, 84, 383/86, 62; 229/69, 70

[56] References Cited

U.S. PATENT DOCUMENTS

| | | | |
|---|---|---|---|
| 4,468,811 | 8/1984 | Shaw et al. | 383/5 |
| 4,807,805 | 2/1989 | Rutkowski | 229/69 |
| 4,941,196 | 7/1990 | Edelman et al. | 383/5 |
| 5,546,732 | 8/1996 | Coleman et al. . | |

FOREIGN PATENT DOCUMENTS

| | | | |
|---|---|---|---|
| 393841 | 10/1990 | European Pat. Off. | 383/5 |
| 1340447 | 12/1973 | United Kingdom | 383/84 |
| 2752120 | 5/1979 | United Kingdom | 383/84 |
| 1594734 | 8/1981 | United Kingdom | 383/84 |

*Primary Examiner*—Jes F. Pascua

*Attorney, Agent, or Firm*—Hovey, Williams, Timmons & Collins

[57] ABSTRACT

A method and apparatus for making a self-sealable packaging, and the self-sealable packaging and method of use are disclosed. The apparatus includes dispensing a web and converting it by folding or by welding two webs together to provide upper and lower layers defining a pocket therebetween. A line of weakness is provided in an extension on the lower web, and a release liner is positioned over the line of weakness in spanning relationship, with a pattern of adhesive applied between the release liner and the extension below the line of weakness. The release liner is secured to the extension above the line of weakness, and the web is sealed along side boundaries and separated therealong to provide individual bags. The pocket of the bag is sized to receive an article, such as a newspaper therein. After insertion of the newspaper, the extension is separated along the line of weakness to provide a flap carrying the adhesive. The flap is folded over the opening of the pocket to adhesively secure the newspaper therein.

16 Claims, 3 Drawing Sheets

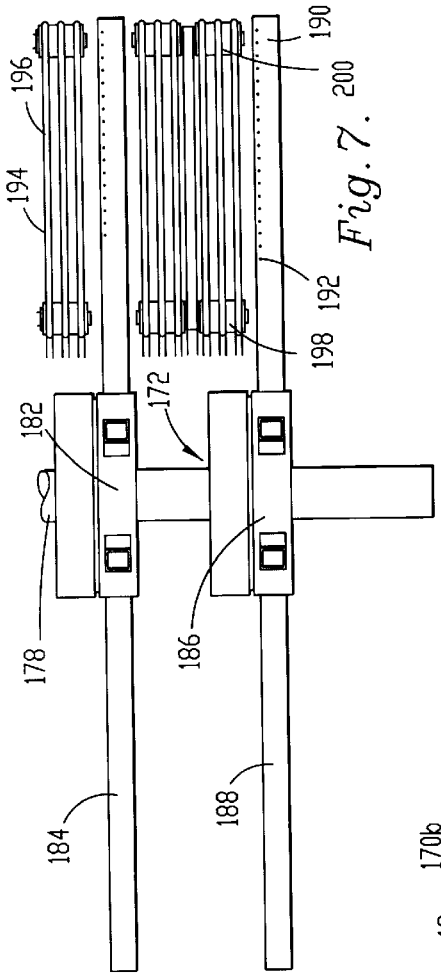
Fig. 7.
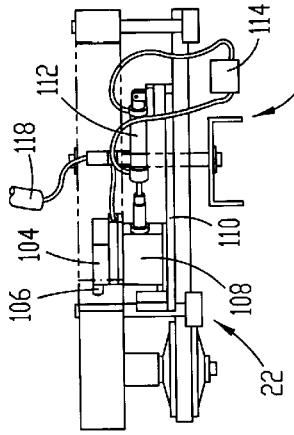
Fig. 4.
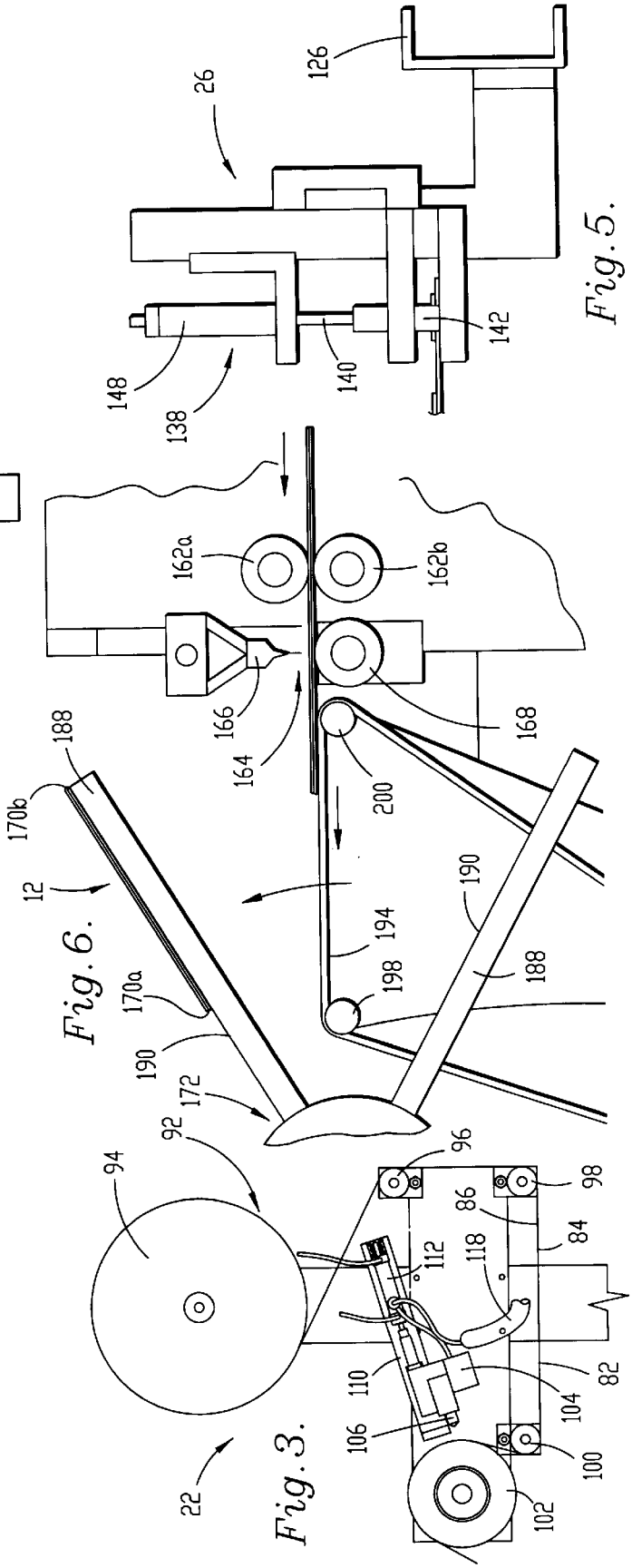
Fig. 5.
Fig. 6.
Fig. 3.

SELF-SEALABLE PACKAGING FOR ENCLOSING ARTICLES

BACKGROUND OF THE INVENTION

1. Field of the Invention

A self-sealable packaging for receiving articles such as, for example, newspapers is provided which includes a bag having an extension which has an adherable flap separable along a line of weakening from a wicketing tab. More particularly, the flap is provided with adhesive received from a release strip which remains with the wicketing tab when the flap is separated therefrom.

2. Description of the Prior Art

Newspapers are commonly delivered by a carrier to the home of the subscriber in a synthetic resin bag. The bag serves to maintain the assembled, flat or rolled configuration of the newspaper and protect it, at least partially, from the elements until retrieved by the subscriber.

However, the bag is usually unsealed, and during heavy precipitation, moisture may enter the open end of the bag and soak the newspaper. Additionally, when product samples or valuable coupons are removed from an unsealed bag, the value to the advertiser is reduced and subscribers noticing the removal may require the carrier to make restoration of the missing components. These conditions not only aggravate the subscriber who is confronted by an unreadable newspaper, but result in the carrier being required to make follow-up deliveries at substantial incremental expense. The additional time and effort required to deliver supplemental newspaper copies to individual homes on a timely basis is not only costly in terms of expense but requires considerable administrative time to receive the complaints of subscribers and coordinate additional deliveries. When a significant percentage of all the newspapers in a delivery are affected, the burden placed on the carrier is heavy.

In at least one instance, a newspaper carrier has resorted to heat sealing newspapers in synthetic resin bags prior to delivery. This involves hand sealing each bag with apparatus which must be set up at a central location and requires a separate operator and source of power for the heat sealer. From a practical standpoint, hundreds of sealers and therefore hundreds of additional operators are necessary to package and seal the bags for delivery of newspapers for a newspaper with a large circulation. In addition, hand sealing using a heat sealer often results in an incomplete seal, thereby leaving an opening for water to seep in. Finally, the bags are sealed at one location, with the necessity of then transporting bags in slippery packaging which is difficult to control and contain.

For the reasons set forth above, there has developed a need for a simplified bag which can be stored until the time for use.

There has also developed a need for a simplified method of sealing a newspaper or other article within a bag which provides for ease of use and allows the bag to be filled and sealed virtually at the last point of handling before delivery.

There has also developed a need for a machine and system for manufacturing a self-sealable bag having the ability to be stored and used as set forth above, as well as a method of making such bags.

SUMMARY OF THE INVENTION

The objects set forth above are largely met by the present invention. That is to say, a simplified self-sealable packaging in the form of a delivery bag which encloses and seals a newspaper is provided, which yields a simplified method of sealing and filing, and a machine and method for making such a bag is disclosed herein.

Broadly speaking, the self-sealable packaging in accordance with the present invention includes a bag presenting an extended flap from which a wicketing tab extends. The wicketing tab is severable along a line of weakness provided by cutting, scoring or perforations. A release liner is provided which straddles the line of weakness and is secured to the wicketing tab, and is provided with adhesive between the release coating and the flap. As used herein, the term adhesive is intended to include both conventional adhesives such as pressure-sensitive adhesives and co-adhesives or binary adhesives where the co-adhesive only adheres to a complementary material on the receiving surface. Alternatively, the reverse side of the extension can receive a silicone or other release coating to inhibit premature attachment between adjacent bags. In a further alternate embodiment, the extension may receive a silicone or other release coating on the front side thereof above the line of weakness, a layer of adhesive applied to the front side of the extension below the line of weakness, and the extension thereafter folded so that the release coating is superposed over the line of adhesive so that a portion of the extension above the line of weakness bearing the release coating covers and protects the adhesive against premature securement to adjacent bags in the group. The bag may be secured to a plurality of other bags by a wicket or header to form a bag group. In use, the user, such as a newspaper deliveryman, inserts a newspaper into the pocket of the bag, then tears the bag and extended flap from the wicketing tab along the line of weakness. The release liner remains secured to the wicketing tab but the adhesive remains with the flap. The user then simply folds the flap over the bag opening to seal the flap to enclose the bag and seal the contents therein. The self-sealable bag preferably seals with a permanent adhesive which reveals tampering or opening by tearing the bag material during opening.

The apparatus hereof first produces a bag from synthetic resin bag stock. The bag may be produced by mating together a narrow web onto a wide web or by folding a single wide web over a turnbar assembly to yield a bag with an extension adjacent the bag opening. The extension is passed through a perforator or scoring knife to provide a line of weakness defining on the bag side the extended flap and on the other side remote to the bag a wicketing tab. A release coating is then applied to the extension over the perforation applying a release coating to the bag material or by a release liner, with adhesive applied to either the extension directly or to the release liner for securing the release liner to the flap. The release liner is also secured to the wicketing tab by, for example, welding the release liner thereto. The release liner remains secured to the bagstock material as it is punched for wicketing and thereafter sealed and separated into individual bags with each bag joined at the side margins. The bags are then passed to a wicketing machine for collection into bag groups of a selected number, e.g. 50 or 100, individual bags.

The method of making the self-sealable packaging hereof thus broadly includes the initial step of mating bagstock material of a first short ply over a second, long ply, with the plys positioned in superposed relationship and joined at one end to present an extension on the long ply. A line of weakness is then applied to the extension to define a wicketing tab on the free edge side of the line of weakness and a flap on the bag side of the line of weakness. Adhesive is applied to the flap of the extension on its front side, which may be applied directly to the flap or more preferably transferred by placement of a release liner carrying the adhesive which is placed over the line of weakness in spanning relationship to cover the adhesive on the bag side of the extension. The release liner readily separates from the adhesive, but it may be appreciated that a release coating may be applied directly to the bagstock material on the reverse or backside of the extension to inhibit premature and undesired attachment between adjacent bags in a group. The portion of the release liner on the wicketing tab side of the extension is secured thereto by welding, adhesive, stapling or other securing means. Preferably, wicketing holes are punched through the wicketing tabs, although alternatively headers may be affixed to the finished bags as a group. The plys are then welded at their sides and separated therealong to form individual bags. Most advantageously, openings are punched in the extension across the line of separation or other means such as slitting along the sides where the release liner adjoins the extension are employed to eliminate or minimize the side welding of the release liner when synthetic release liners are employed. After the individual bags are formed, they are placed on a conventional wicketing machine for grouping and application of wire wickets or headers. Alternatively, the bags may be provided in an unheadered condition secured by conventional means such as hot needling or staples, or provided individually and ungrouped.

The method of using the self-sealable bags includes providing at least one bag having a pocket with an extension divided along a line of weakness into a tab and a flap, the flap having adhesive thereon and a release liner applied over the adhesive and line of separation and secured to the tab. Thereafter, an article is placed into the pocket of the bag either manually or by machine insertion. The bag is then removed from the tab by separation along the line of weakness, whereupon the release liner remains affixed to the tab and a substantial portion of the adhesive remains adhered to the flap. The final step in the method of use includes bringing the flap and adhesive into contact with the outer ply of the bag to close the opening of the bag and enclose the article in the pocket.

Modifications and particular features of the foregoing invention will be readily apparent to those skilled in the art after reviewing the following description of the drawings and detailed description of the preferred embodiment.

BRIEF DESCRIPTION OF THE DRAWINGS

FIG. 3 is an enlarged fragmentary elevational view of the hot glue applicator for applying thermoplastic glue to the release liner before the liner is applied to the extension;

FIG. 4 is a fragmentary elevational view of the hot glue applicator of FIG. 3 with the release liner feedroll shown in phantom for clarity;

FIG. 5 is a side elevational view of a punch station for applying wicketing holes and side margin holes through the bag extension and release liner taken along line 5—5 of FIG. 1;

FIG. 6 is a fragmentary enlarged side elevational view of the discharge station for delivering finished bags to the wicketing station;

FIG. 7 is a top plan view of the discharge station with the bags wicketing station removed for clarity;

DESCRIPTION OF THE PREFERRED EMBODIMENT

Figures 1, 2, 10:
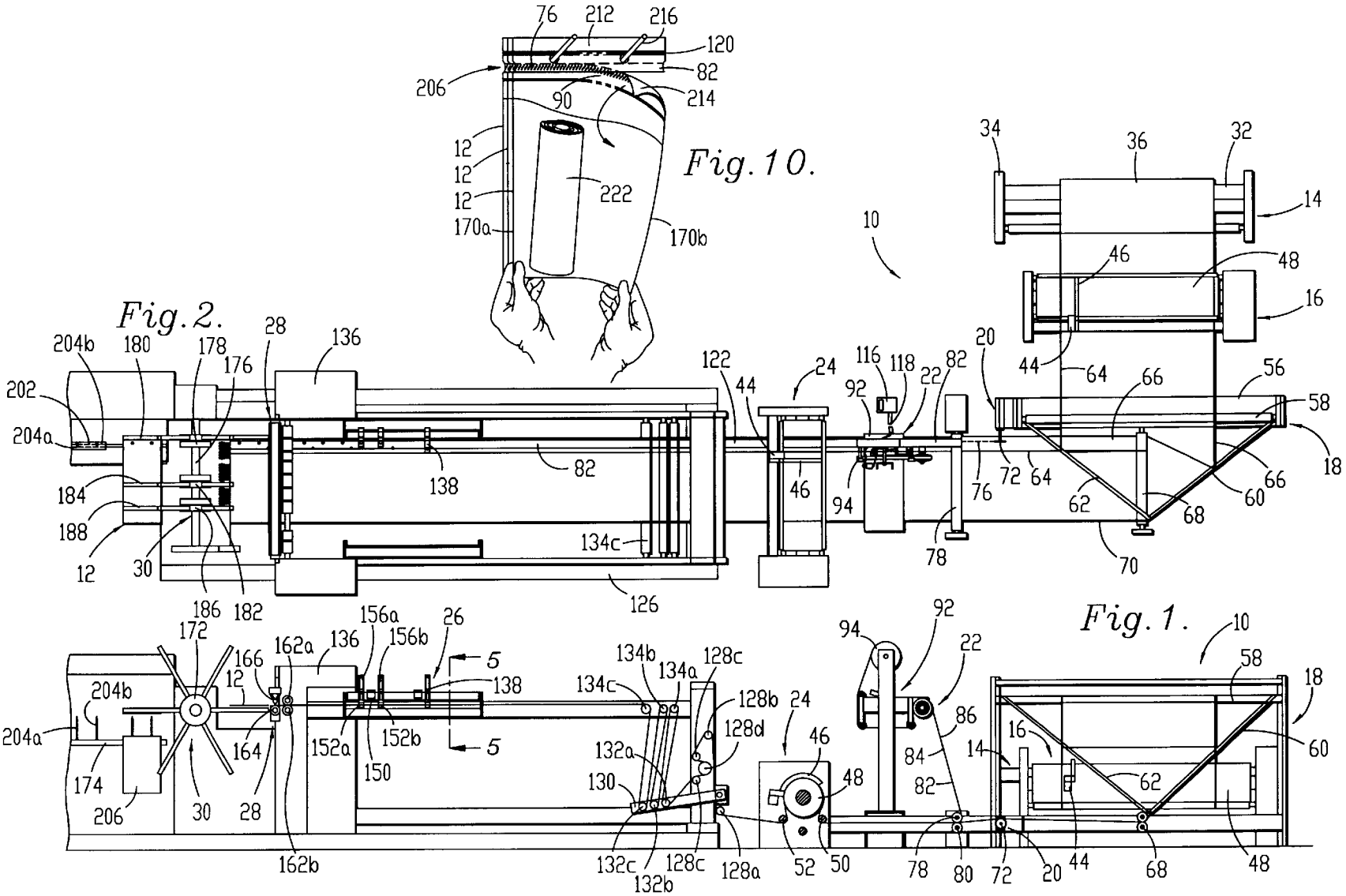
FIG. 1 is a side elevational view of the apparatus for making a self-sealable packaging in accordance with the present invention, with a portion of the wicketing station omitted for clarity.
FIG. 2 is a top plan view thereof, showing the bagstock feedroll leading to the turnbar assembly at the upstream end and the wicketing station at the downstream end.
FIG. 10 is a perspective view showing the topmost bag of a group of sealable bags being separated from the wicketing tab for closing the flap to seal a newspaper therein.

Referring now to the drawing, an apparatus 10 for producing a self-sealable packaging 12 (see FIGS. 8, 9 and 10) in accordance with the present invention is shown in FIGS. I and 2 and broadly includes a web dispensing station 14, a web sealing station 16, a turnbar assembly 18, a perforation station 20, a release liner applicator station 22, release liner securement station 24, punch station 26, cutting station 28, and discharge station 30.

In greater detail, web dispensing station 14 includes a conventional web roller 32 on which is mounted a roll stand 34 of web material 36. The web material 36 of may be either a single ply or, as shown in the preferred embodiment, a continuous tubular web 38 providing two plys 40 and 42 as shown in the finished packaging 12. The web material 36 is most economically provided of linear low-density polyethylene although other synthetic resins may be used.

Figure 9:
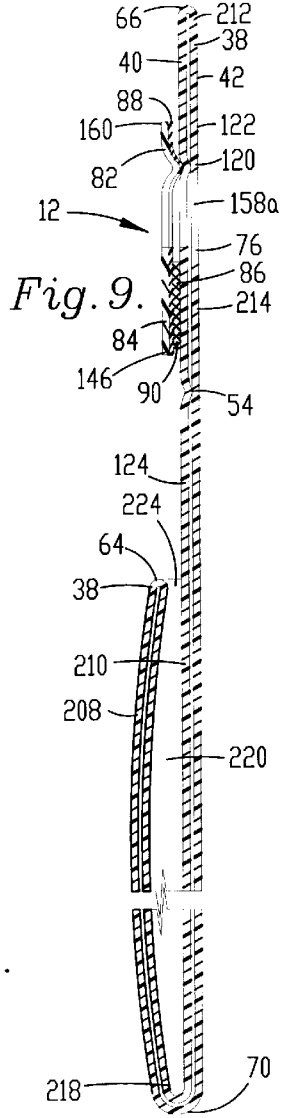
FIG. 9 is a foreshortened vertical cross-sectional view along line 9—9 of FIG. 8, showing the positioning of the weld securing the release liner to the wicketing tab above the line of separation and the adhesive applied between the flap and the release liner.

The web sealing station 16 and the release liner sealer station include a hot air sealer 44 such as model D 6094 by Atlanta Mesco of Marietta, Ga., having a hot air sealing arm 46, sealing drum 48, and web guide rollers 50 and 52 which guide web 38 between sealing arm 46 and sealing drum 48 for sealing plys 40 and 42 together at weld 54 as seen in FIG. 9. As a result, the plys 40 and 42 are provided with additional structural connection and inhibited from separation and the entry of moisture therebetween.

Turnbar assembly 18 includes web roller 56 which routes the web 38 up to upper roller 58 and then to fold bars 60 and 62. Fold bar 60 receives the portion of web 38 which includes pocket margin 64, and fold bar 62 receives the portion of the web 38 which includes tab margin 66. The web 38 is routed over fold bars 60 and 62 to orient the web 38 generally downwardly and toward mating roller 68, where tab margin 66 is directed to be lower than and laterally outboard of lower than the pocket margin 64 which is above and inboard of the tab margin 66. The mating roller 68 thus redirects the web 38 at a ninety degree angle to its initial orientation from the web dispensing station 14 to the web sealing station 16, and creates a bag fold margin 70 on the near edge of the web as seen in FIG. 2.

Figure 8:
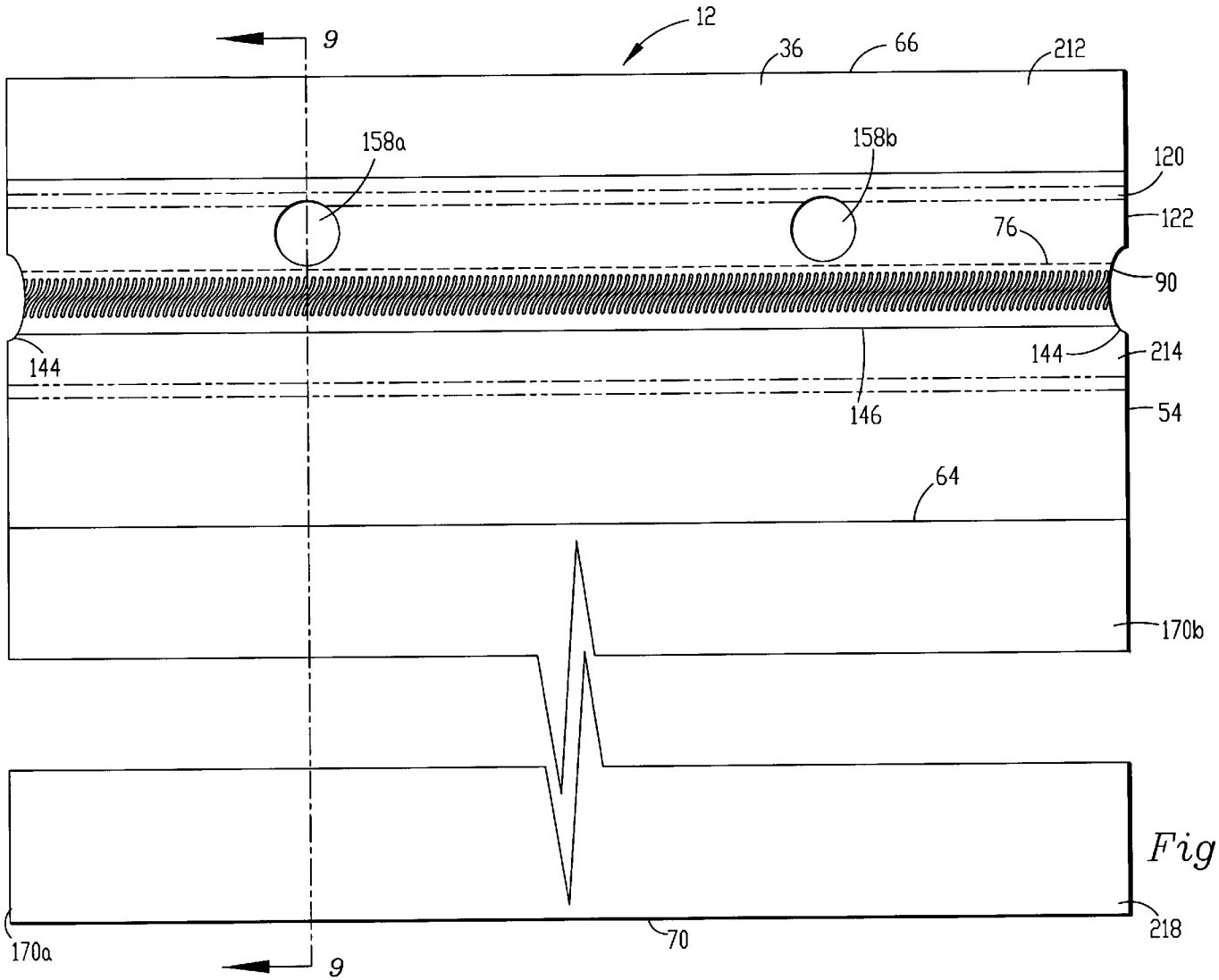
FIG. 8 is a front elevational view of the self-sealable bag in accordance with the present invention with the pocket portion of the bag foreshortened.

The folded web 38 next moves to perforation station 20 and passes over a perforation wheel 72 rotatably carried by perforation wheel arm 74 which is mounted to frame 76 of turnbar assembly 18. The perforation wheel 72 is preferably constructed to provide a greater degree of perforation than connection and thus an aggressive perforation pattern in the line of weakness 76 in the packaging as seen in FIG. 8. Alternatively, a scoring wheel may be provided to score the web 38 instead of perforations, or the station 20 may be positioned downstream of the release liner securement station 24 and a cutting wheel substituted for perforation wheel 72 to completely sever the web and thereby provide a line of weakness. However, perforations are used in the preferred embodiment shown and described herein.

The release liner applicator station 22 includes opposed press rollers 78 and 80 which receive a release liner web 82 which is applied to the web 38 over the line of weakness 76. The release liner web 82 is preferably a high-density polyethylene strip, although other synthetic resins may be used. The release liner web 82 has an outside face 84 and an inner face 86 to which a conventional silicone release coating 88 has been applied. A layer, line or pattern 90 of adhesive is applied over the release coating 88 by dispenser 92. The adhesive is preferably a pressure sensitive adhesive, and more preferably a thermoplastic pressure sensitive adhesive such as, for example, product number H 2181-01 by ATO Findley of Milwaukee, Wis. As seen in FIG. 8, the adhesive pattern 90 is preferably applied in an intermittent, overlapping pattern to aid in withdrawal of the formed bag from the release liner 82 but still provide good weather-resistant coverage for the packaging 12.

The dispenser 92 is best seen in FIGS. 3 and 4 and includes a supply reel 94, idler wheels 96, 98, and 100, and application wheel 102. A gluing head 104 is mounted opposite applicator wheel 102 and includes a slot die 106 for dispensing the heated adhesive onto the release liner web 82. The gluing head 104 is connected to shoe 108 which is shiftably mounted for linear movement along track 110. Gluing head 104 may be shifted toward and away application wheel 102 by a double-acting air retraction cylinder 112. The cylinder 112, which may be, for example, Model 45A-MA-BM3-1KO by MAC of Wixcom, Mich., which is coupled to pneumatic controller 114. The controller 114 is electronically coupled to a controller on the cutting station 28, whereby the cylinder 112 retracts the gluing head 104 away from the release liner web 82 when the forward progress of the web 38 is stopped and moves the gluing head 104 into proximity to the release liner web 82 for dispensing the pattern 90 of adhesive when the web 38 is being advanced. The gluing head 104 is fluidically connected to a hot melt delivery machine 116 such as a Sure Tack Systems Model 12 by Crist Company of Marietta, Ga. by heated delivery line 118.

Web 38, with release liner web 82 mated thereto is next delivered to release liner securement station 24. The sealing arm 46 provides a weld 120 between the release liner web 82 and the extension 122, defined as that portion of the web 38 outboard of the pocket margin 64 to the tab margin 66 on the back portion 124 of the web 38. The weld 120 inhibits separation of the release liner web 82 from the extension 122, and is located on the tab margin 66 side of the line of weakness 76.

Both punch station 26 and cutting station 28 are mounted on a conventional side weld bag forming machine 126, such as a Model# 308 Sheldahl Packaging Machinery Division of Providence, Rhode Island table having guide rollers 128*a*, 128*b*, 128*c*, 128*d*, and 128*e*, tension arm 130 having pivotally mounted tension rollers 132*a*, 132*b*, and 132*c*, web rollers 134*a*, 134*b*, 134*c* and controller station 136. It may be appreciated that other makes and models of conventional bag making machines could also be used, the aforementioned machine 126 being mentioned as illustrative of one such machine. Punch station 26 includes single hole punch 138 which includes a shaft 140 and hole punch tool 142 for producing a single hole 144 through the extension 122 extending from the line of weakness 76 across the pattern 90 of adhesive to beyond the release liner lower margin 146 as shown in FIG. 8. Shaft 140 is reciprocated by solenoid activated air cylinder 148 timed to produce a hole 144 through the release liner web 82 and the extension 122 at one bag width spacing. Punch station 26 also includes a double hole punch 150 provided with dies 152*a* and 152*b* on hole punch tools configured to produce holes of a round or other desired configuration and simultaneously operated by solenoid activated air cylinders 156*a* and 156*b*. The dies 152*a* and 152*b* are positioned to punch wicket holes 158*a* and 158*b* through extension 122 and release liner web 82 on the tab margin 66 side of line of weakness 76 as shown in FIG. 8 and FIG. 9, but preferably between the remote margin 160 of the release liner web 82 and line of weakness 76.

After punch station 26, cutting station 28 receives web 38 in a folded condition and carrying release liner web 82. Cutting station 28 includes drive rolls 162*a* and 162*b* positioned above and below webs 38, 82 and further includes cutting assembly 164 having vertically shiftable cut-off blade 166 and anvil roller 168 with webs 38 and 82 positioned thereto in between. The cutting blade 166 is provided with a conventional water jacket provided with circulating cooling water positioned around the upper portion of the blade 166 to cool the latter and protect the drive rollers 162*a*, 162*b*. Cutting blade 166 is operatively connected to controller 126 to shift vertically downward into cutting engagement with webs 38, 82 corresponding to passage therebeneath of a single bag width of the webs. The blade 166 shifts downwardly to pinch the webs against anvil roller 168. Under the pressure and heat of the blade 166, a boundary 170 is both sealed and cut. This seals the trailing bag boundary 170*b* of the previously cut bag 12*a* and the leading boundary 170*a* of the webs 38 and 82 to be next cut and sealed.

Discharge station 30 includes bag handling mechanism 172 and bag accumulator 174. Handling mechanism 172 includes axle 176, inboard vacuum hub 178 with six, evenly spaced, radially extending vacuum arms 180 coupled therewith. Handling mechanism 172 further includes intermediate vacuum hub 182 with six, evenly spaced, radially extending vacuum arms 184 and outboard vacuum hub 186 with six, evenly spaced, radially extending vacuum arms 188. Arms 180, 184 and 188 are in registration, that is in parallel, horizontal alignment. Axle 176, and hubs 178, 182, and 186, as well as arms 180, 184 and 188, are hollow and present respective interior chambers in fluid communication and coupled with a conventional vacuum source (not shown) such as a vacuum pump. Furthermore, arms 180, 184 and 188 each include bag receiving faces 190 presenting a plurality of bag-holding, vacuum ports 192 defined therein. Bag handling mechanism 172 further includes a bag conveyor 194 comprised of a plurality of tension cords 196 driven over pulleys 198, 200 in the direction of the arrow shown in FIG. 6 to carry the bags from the cutting station 28 into position for receipt on the vacuum arms 180, 184 and 188.

Discharge station 30 also includes bag accumulator 174 for receiving completed bags carried by handling mechanism 172. Bag accumulator 174 includes a plurality of blocks 202 each presenting a pair of upstanding spikes 204*a* and 204*b* positioned for registration with wicket holes 158*a*, 158*b* in extension 122 of bag 12. During rotation of the bag handling mechanism 172, the extension is supported on inboard arms 180 so that wicket holes 158*b* are in registration with spikes 204*a*, 204*b*. As bag 12 rotates through the discharge position, spikes 204*a*, 204*b* are received in wicket holes 158*a*, 158*b*. As mechanism 172 rotates beyond the discharge position, bag 12 is pulled away from the supporting vacuum arms 180, 184, and 188. Once released, bag 12 then hangs from spikes 204*a,* 204*b*. When a sufficient number of bags have been accumulated, a bag group 206 is carried along block 202 downstream for hot needling, wicketing on a wire wicket, and/or headering with a, e.g. cardboard header either before or after removal from the spikes and then prepared for shipment to the customer.

In accordance with the method of making the bags 12 of the present invention, tubular web 38 is folded to provide an upper layer 208 and a lower layer 210 (which is back side 124). Alternately, upper layer 208 and lower layer 210 may be provided of separate rolls of web stock material and heat sealed along one edge as is known in the art and shown, for example, in U.S. Pat. No. 5,546,732, the disclosure of which is incorporated herein by reference. The upper layer is arranged relative to the lower layer to provide an extension 122 projecting beyond the margin 64 of the upper layer 208 superposed over the lower layer 210. A line of weakness 76 is provided in the extension 122 to define therein a wicketing tab 212 having a relatively remote tab margin 66 and a flap 214 positioned relatively more proximate to pocket margin 64. A layer of adhesive 90 is applied between the flap 214 and a release liner 82. The release liner 82 is mated to the extension 122 over the line of weakness 76 with its release coating 88 adjacent the layer of adhesive 90. The release liner 82 is secured to the wicketing tab 212 by a weld 120 when both release liner 82 and web 38 are of synthetic resin material, or alternatively by mechanical means. When the web 38 is supplied continuously, hole 144 is provided along the boundary 170 where each bag 12 is to be cut and sealed in order to inhibit a sealing connection from occurring between the release liner 82 and the extension 122. The continuous web 38 is sealed and separated into individual bags 12 along a boundary 170 at selected intervals corresponding to the width of the bag 12. Each bag is also preferably punched to provide wicket holes 158*a* and 158*b* through the release liner 82 and the wicketing tab 212. The individual bags 12 are preferably assembled in superposed relationship into bag groups 206 as shown in FIG. 10, and a wire wicket 216 passed through the wicketing holes 158. Alternatively, the individual bags 12 of a bag group 206 may be held together by staples, hot needling or by stapling a cardboard header to the wicketing tabs 212 to hold the individual bags 12 together as a collective group.

The bag 12 made according to the method using the apparatus 10 is shown in FIGS. 8 and 9. Bag 12 is shown made of a folded double-wall tubular web 38 wherein the web material is 1 mil thickness linear low-density polyethylene film, although it is to be understood that a single thickness web may be used of any suitable thickness, and the web material 36 may be polyester or polyethylene for higher strength and higher heat resistance. The web 38 is folded along bag fold margin 70 to present upper layer 208 and lower layer 210 which is longer than upper layer to present extension 122. Alternatively, separate webs for the upper layer 208 and lower layer 210 may be provided and heat sealed together to provide a closed bottom 218 instead of folding web 38 at fold margin 70. The use of the terms "bottom", "upper" and "lower" are used merely to orient the reader to the illustrated positioning in the illustrated embodiment, it being understood that the bag may have any orientation during use and may be manufactured having the longer web on top by adaptation of the apparatus 10 readily apparent to those skilled in the art.

Each bag 12 is sealed along boundaries 170*a* and 170*b* to provide a pocket 220 for receiving therein a newspaper 222 or other article as shown in FIG. 10. The pocket 220 is defined between upper layer 208 and lower layer 210 and defined at the top by pocket margin 64, at the bottom by bag fold margin 70, and at the sides by boundaries 170*a* and 170*b*. The extension 122 is located upwardly as shown in FIGS. 8 and 9 of the bag fold margin 70. Line of weakness 76 divides the extension into an uppermost wicketing tab 212 and a flap 214 below the line of weakness 76. The line of weakness, provided by perforations, scoring or cutting through the extension 122, extends the width of the bag 12 between the boundaries 170*a* and 170*b*. A release liner 82 is provided with a silicone release coating 88 over its inner face 86, and is applied over the line of weakness 76 whereby a portion of the release liner 82 is placed over both the wicketing tab 212 and the flap 214. A pattern 90 of adhesive, such as a thermoplastic pressure-sensitive adhesive, is intermediate the release coating 88 and the flap 214, and remains adhered to the flap 214 when the bag is separated along the line of weakness.

Holes 144 are located along boundaries 170*a* and 170*b* to eliminate sealing of the release liner 82 to the flap 214 along the boundaries of the bag 12. The holes extend to and preferably slightly above the line of weakness 76 and to and preferably slightly below the bottom edge 146 of the release liner 82. Weld 120 secures the release liner 82 to the wicketing tab 212 above the line of weakness 76. Weld 54 secures the first ply 40 to the second ply 42 of the web 38 in the flap 214 below the line of weakness 76 to prevent separation of the plys 40, 42 after separation of the flap 214 from the wicketing tab 212 along the line of weakness 76. Weld 54 is not necessary when a single layer as opposed to double ply web 38 is used as the starting material. The pattern 90 may be a continuous or intermittent line of adhesive, but an overlapping, intermittent pattern 90 as shown in FIG. 8 provides good moisture intrusion resistance while facilitating removal of the flap 214 from the release liner 82. Wicket holes 158 are provided through the wicketing tab 212 and the release liner 82 to receive a wire wicket 216 therethrough. The wicketing tab 212 and the release liner 82 of all of the bags 12 in a bag group 206 are thus held by the wicket 216, header or the like.

In the method of using the bag 12 hereof, the newspaper carrier first inserts a newspaper 222 into the opening 224 between the pocket margin 64 and the lower layer 212 of the topmost bag 12 in the group 206 so that the newspaper 222 is received in the pocket 220. The carrier then grasps the topmost bag 12 adjacent the bottom 218 and separates the flap 214 from the wicketing tab 212 along the line of weakness 76 by a sharp tug. The pattern of adhesive 90 is transferred from the release liner 82 to the flap 214 and carried therewith. The wicketing tab 212 and release liner 82 remain with the wicket 216 or header, which is secured to a suitable support. The flap 214 is then extended across the pocket margin 64 and adhered to the upper layer 208 to enclose the newspaper 222 within the pocket 220. With the bag 12 thus closed and sealed, the bag 12 with the newspaper therein is substantially more resistant to precipitation. After delivery, the reader breaks open the bag 12 through any of the thin web layers to gain access to the newspaper therein.

As a result of the present invention, the newspaper may be easily sealed in a bag which is self-sealable, that is, does not require additional equipment to accomplish sealing. The newspapers may be stored in a flat condition until just prior to delivery, and the sealing may be accomplished at remote sites to include the delivery vehicle. This permits the newspaper carrier to adapt to changing weather conditions to preserve the dry condition of the newspaper at the delivery site.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby states their intent to rely on the Doctrine of Equivalents to determine and assess the reasonably fair scope of their invention as pertains to any apparatus not materially departing from but outside the literal scope of the invention as set out in the following claims.

We claim:

1. A bag comprising:

first and second superposed layers of bag material joined to form a pocket therebetween having a pocket opening;

an extension extending from one of said layers adjacent said opening and presenting a distal edge, said extension including structure defining a line of weakness thereacross and presenting a tab between said line of weakness and said edge and a flap between said line of weakness and said opening;

a release liner extending across said extension in spanning relationship with said line of weakness;

coupling means permanently joining said liner and tab so that said release liner remains with said tab after separation of said tab from said flap along said line of weakness; and adhesive separate from said coupling means between said liner and flap, said flap having an affinity for said adhesive, said liner including means inhibiting adhesion with said adhesive for enabling release of said flap from said liner and for enabling said adhesive to remain with said flap upon separation from said tab along said line of weakness, said flap being configured for closing said opening in a closed position, said adhesive being positioned for adhering said flap to the other of said layers for maintaining said closed position.

2. The bag as set forth in claim 1, said bag material including synthetic resin material.

3. The bag as set forth in claim 2, said bag material including one of polyethylene and polyester.

4. The bag as set forth in claim 1, said layers being joined by heat sealing.

5. The bag as set forth in claim 1, said one of said layers integrally including said extension.

6. The bag as set forth in claim 1, said line of weakness including perforations.

7. The bag as set forth in claim 1, said adhesive including pressure sensitive adhesive.

8. The bag as set forth in claim 1, said adhesive spanning said flap and presenting a pattern configured for providing a seal between said flap and the other of said layers.

9. The bag as set forth in claim 1, said means inhibiting adhesion including a silicone release coating on said liner.

10. The bag as set forth in claim 1, said bag being one of a plurality of said bags with the respective tabs thereof coupled to form said bags into a group.

11. The bag as set forth in claim 1, said tab including a plurality of holes defined therein configured for receiving the tines of a wicket for supporting said bag.

12. The bag as set forth in claim 1, each of said layers being formed of two plys of said bag material.

13. The bag as set forth in claim 1 presenting opposed side edges joined by heat sealing.

14. The bag as set forth in claim 1 presenting a bottom edge opposite said opening with said bottom edge being formed as a fold line of said bag material.

15. The bag as set forth in claim 1, said extension having side margins and said release liner having a bottom edge, and including a hole in said release liner over each of the side margins of said extension and extending from below the bottom edge distally past said line of weakness in said extension.

16. The bag as set forth in claim 15, said extension having holes along each side margin aligned with the holes in said release liner.

* * * * *